United States Patent [19]

Ahad

[11] Patent Number: 4,510,779

[45] Date of Patent: Apr. 16, 1985

[54] AIRCRAFT DOOR LOCK ACTUATING MECHANISM

[75] Inventor: Munir J. Ahad, Valencia, Calif.

[73] Assignee: Adams Rite Products, Inc., Glendale, Calif.

[21] Appl. No.: 399,056

[22] Filed: Jul. 16, 1982

[51] Int. Cl.[3] ..... E05B 13/10; E05B 65/10

[52] U.S. Cl. ..... 70/208; 70/92; 70/481; 70/DIG. 42; 292/DIG. 31

[58] Field of Search ..... 70/208, DIG. 59, DIG. 42, 70/92, 215, 467, 481, 489; 292/92, 21, 336.3, 359, DIG. 31, DIG. 62, DIG. 65, DIG. 71

[56] References Cited

U.S. PATENT DOCUMENTS

| | | | |
|---|---|---|---|
| 2,131,033 | 9/1938 | Barrington et al. | 70/208 |
| 2,176,969 | 10/1939 | Johns | 292/DIG. 31 X |
| 2,223,236 | 11/1940 | Barrington et al. | 70/208 |
| 2,239,301 | 4/1941 | Papst | 70/208 |
| 2,246,708 | 6/1941 | Wieben | 70/208 |
| 3,044,815 | 7/1962 | Soss | 70/489 X |
| 4,134,281 | 1/1979 | Pelcin | 70/208 |

FOREIGN PATENT DOCUMENTS

| | | | |
|---|---|---|---|
| 294682 | 10/1969 | Australia | 70/92 |
| 2084643 | 4/1982 | United Kingdom | 70/292 |

*Primary Examiner*—Gary L. Smith
*Assistant Examiner*—Russell W. Illich

[57] ABSTRACT

An aircraft door latching bolt actuating mechanism in which inside and outside handles are provided to selectively actuate a crank having connections with one or more door latching bolts. The outside handle is supported for movement between a normal, generally flush non-operative position and a non-flush operative position permitting movement of the crank to a bolt releasing position. In one form, the handle is pivoted between its ends for swinging movement between its flush and non-flush positions, and in another form is spring biased for pop-up movement from the flush to non-flush position. The outside handle is normally retained in its flush position by a latch or lock engaged with a releasable keeper which can be manually released from the door exterior to enable use of the outside handle. When utilizing the inside handle, a connected first cam operates to release the keeper to enable movement of the pop-up handle embodiment to its non-flush position. In the case of the pivotally swingable handle, a connected second cam is utilized to move the released outside handle to its non-flush position. Movement of the outside handle to the non-flush position thus serves as a visual exterior indication that the door has been unlocked.

14 Claims, 7 Drawing Figures

AIRCRAFT DOOR LOCK ACTUATING MECHANISM

BACKGROUND OF THE INVENTION

The present invention relates generally to door locking bolt mechanisms, and manually operable means for the actuation of such bolts.

When such mechanisms are installed for utilization on aircraft doors, such as a cabin door mounted in the skin structure of the main passenger cabin, the conventional installation provides outside and inside handles which are selectively operable for the actuation of the bolts.

More specifically, one prior known arrangement has utilized a T-shaped inside handle which is secured to one end of a rotatably mounted main shaft in the door structure, this shaft being connected with an actuating crank that is operatively connected with the door bolts. An outside door handle comprises a single hand-grip lever that is pivoted at one end to the outer end of the main shaft for swinging movements between a retracted substantially flush seated position in a recess of an outside escutcheon plate so as to releasably latch the crank in a bolted position. A spring at the pivoted end of the handle normally urges the hand-grip lever into retracted position. Adjacent its pivoted end, the lever is provided with a roller which is adapted, upon rotation of the main shaft by the inside handle, to ride up an arcuate cam ramp and thus move the lever out of its latching recess as continued rotation of the main shaft moves the crank to a bolt unlocked position. The single outside hand-grip lever may also be utilized to actuate the crank and move it to a bolt unlocked position. For this operation, a finger may be inserted under the outer end of the lever, and by exerting a pulling force move the lever to a tilted unlatched extended position and then rotated to actuate the crank.

For some installations, it has been found that it would be advantageous to provide a latch or lock on the outside handle, which could be manually released from the door exterior. However, the provision of such an expedient poses a problem with respect to being able, through the actuation of the inside handle, to move the outside handle from its recessed position to its extended position.

The present invention comprises an improvement over the prior known structures, and proposes to provide an outside handle of the pivotal swingable type or pop-up type which normally occupies a generally flush locked or latching nonoperating position, and upon release is movable to a non-flush operating position. Unique camming means are provided for releasing the latch or lock of the pop-up handle type in response to actuation of the locking mechanism by the inside handle.

In the case of the swingable type outside handle, the camming means first releases the latch or lock and then functions to swingably move the handle from its flush position to the non-flush position. In the non-flush position, the outside handle thus provides the desirable feature in which it serves as a visual outside indication that the door has been unlocked from the inside.

SUMMARY OF THE INVENTION

The herein described invention is more particularly concerned with an improved actuating handle mechanism for the actuation of the bolts on airplane doors, and in particular the main doors of the passenger cabin.

It is one object of the herein described invention to provide an improved bolt actuating mechanism for an aircraft door in which outside and inside actuating handles are selectively operable to move the bolts into an unbolted position, and wherein actuation of the bolts by the inside handle will be operative to move the outside handle to a position in which it serves as an indication that the door has been unlocked from the inside.

A further object is to provide an aircraft door locking bolt actuating mechanism in which an outside bolt actuating handle is movable between a generally flush position to a non-flush position for actuation of the door bolts, and wherein the handle is releasably latched or bolted in its flush position, and in which actuation of the door bolts by an inside handle will operate through camming means to first release the latch or lock of the outside handle for movement to a non-flush position as an indication of the actuation of the door bolts by the inside handle.

It is also an object of the present invention to provide an aircraft door bolt actuating mechanism according to the previous object in which, in the case of a pivotally swingable outside handle, the camming means will also function to swing the unlatched or unlocked handle from its generally flush position to its non-flush position.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only.

DESCRIPTION OF THE SEVERAL EMBODIMENTS OF THE INVENTION

Figure 1:
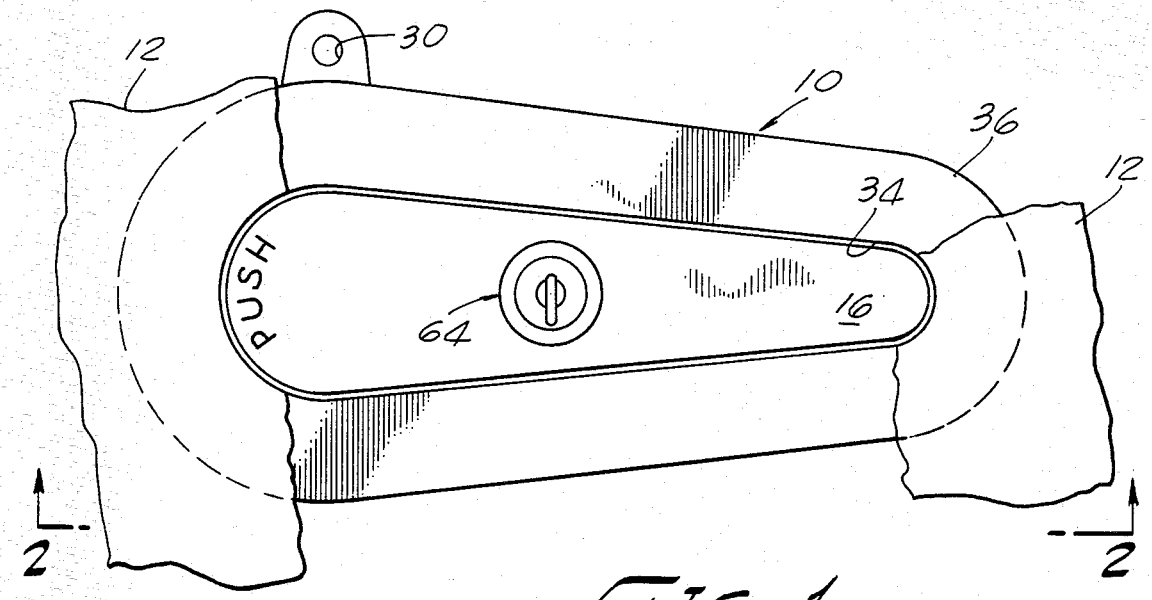
FIG. 1 is a fragmentary outside elevational view of the outside handle structure according to the present invention, portions being broken away to disclose underlying parts of the frame of the structure.
Figure 2:
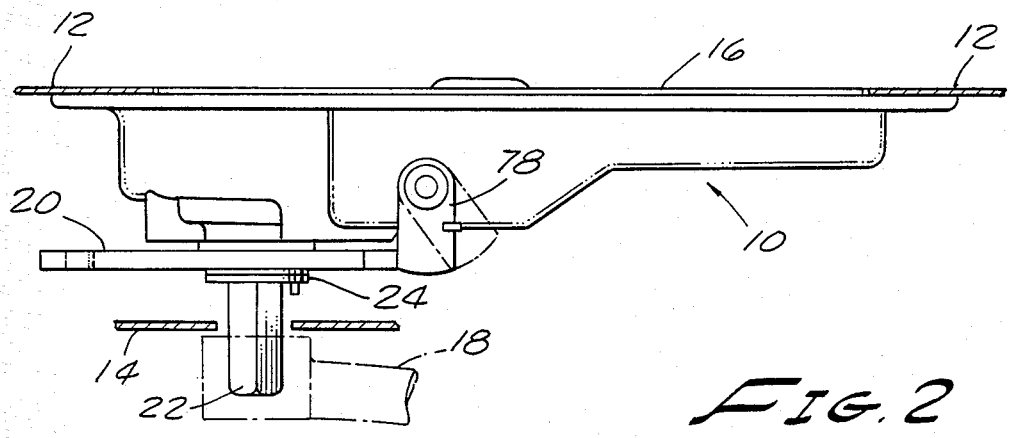
FIG. 2 is a bottom plan view, partly in section, as seen along line 2—2 of FIG. 1, to show details of the connected inside handle and bolt actuating means.

Referring more specifically to the drawings, for illustrative purposes, the invention is shown in one embodiment in FIG. 1 as generally comprising a frame housing structure 10 which is arranged to be mounted by conventional means between the outer skin 12 and inner skin 14 of an aircraft door, such as the main door of a passenger cabin or other compartment. Characteristically, these doors are arranged to be secured in a closed position by means of one or more locking bolts (not shown). The bolt actuating mechanism of the present invention is directed to a manually operable handle arrangement which may be selectively operable by means of an outside handle 16 or inside handle 18 to lock and unlock the latching bolts of the door in a manner well known in the prior art.

Figure 3:
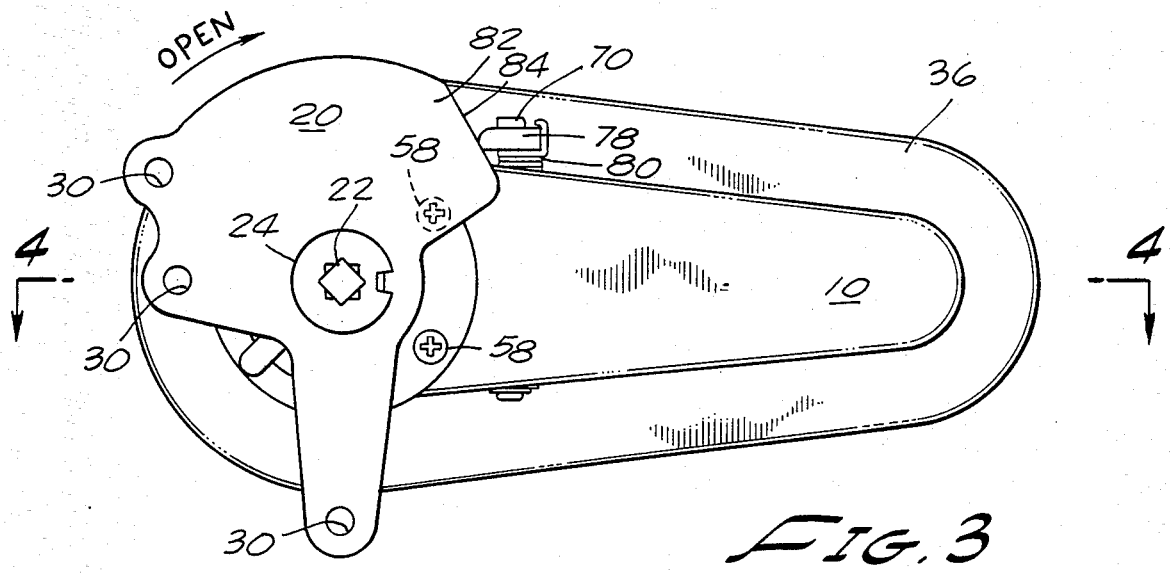
FIG. 3 is an inside elevational view.
Figure 4:
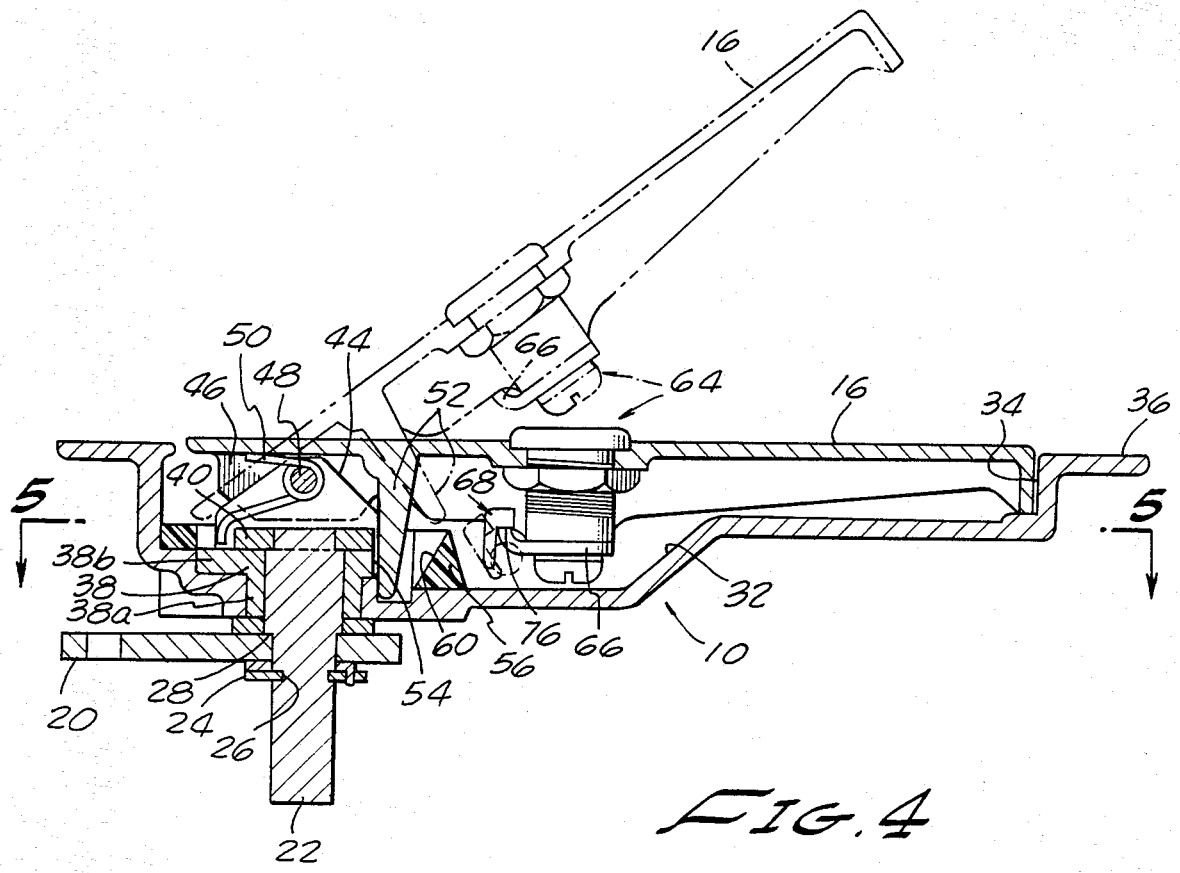
FIG. 4 is a longitudinal sectional view, taken substantially on line 4—4 of FIG. 3 to show the cooperative relationship of interconnecting elements between the inside and outside handles.

The handles are operable to actuate a multi-armed bell crank 20 which is shown in FIGS. 3 and 4 as being mounted upon a rotatable spindle 22 which is adapted for direct connection with the inside handle 18. The bell crank 20 is fabricated from plate material and is secured to the spindle in non-rotative relation by means of a washer assembly 24 in which one of the washers is seated in a spindle groove 26 in a manner to axially retain the bell crank in abutment with a radial shoulder 28 on the spindle. The bell crank is provided with a plurality of openings 30 for facilitating connection with bolt actuating rods, over-center stop position holding spring means and the like depending upon the requirements of a particular installation.

The housing 10 is stamped or otherwise formed to provide an internal cavity 32 having a peripheral side opening 34 which is surrounded by an outwardly extending peripheral escutcheon flange 36 to facilitate mounting in association with the outer skin 12 of the door.

The spindle 22 is formed to provide a head end portion which is rotatably mounted within an axially extending bore of a cylindrical hub member 38 having an integrally formed cylindrical collar **38*a* and an outwardly extending radial end flange 38*b* and which have outer surface rotative bearing engagement with adjacent wall portions of the housing structure 10**.

The head end of the spindle 22 extends through the hub member 38 and is nonrotatively connected with a head plate member 40 for rotational oscillatory movement over the adjacent surface of the hub member 38.

Figure 5:
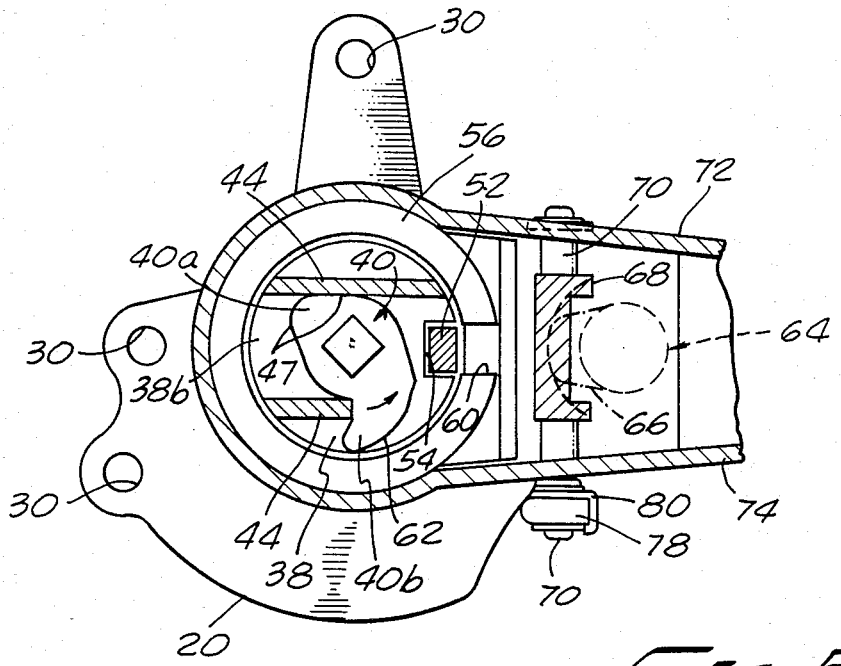
FIG. 5 is an enlarged fragmentary sectional view, taken substantially on line 5—5 of FIG. 4 to show details of camming means for moving the outside handle from a generally flush position to a non-flush position, and camming means for releasing a holding keeper for retaining the outside handle in flush position.

As best shown in FIG. 5, the head plate 40 is configured to provide a radially projecting end lobe **40*a* having outwardly converging abutment edges 42 for engagement respectively with spaced apart upstanding hub lugs 44 oscillatory rotative movements of the spindle 22 by the inside handle 18 all by oscillatory rotative movements of the lugs 44 by the outside handle 16 which is supported upon the lugs 44** in a manner which will hereinafter be described in detail.

As shown in FIG. 4, the outside handle 16 is peripherally conformed to fit within the side opening 34 of the frame housing structure 10, and at one end is provided on its undersurface with a pair of laterally spaced supporting lugs 46 which are outwardly positioned with respect to the hub lugs 44 and are pivotally supported thereon by being engaged with the ends of a pivot pin 48 for swinging movement between a substantially flush non-operative position in the side opening 34, and a fully tilted operative non-flush position as disclosed in phantom lines. The outside handle is normally biased towards its flush position by means of a torsion spring 50 which is coiled about the pivot pin 48 and has one end bearing against the adjacent surface of the radial end flange **38*b* of the hub member, and its other end bearing against an adjacent surface of the outside handle 16. As shown in FIG. 1, the adjacent end of the outside handle 16 carries the indicia "PUSH". By pushing on this end of the handle, the handle may be manually moved to a complete angular operative position of substantially 37** degrees, as indicated in phantom lines.

Between the pivot pin 48 and the opposite end of the outer handle, the handle is provided with a generally right-angled extending tongue portion 52 which is tapered towards its outer end and adapted in the flush position of the handle 16 to occupy a seated position within a peripheral slot 54 of the radial flange **38*b*. An annular plastic insert 56 is secured in a position surrounding the periphery of the hub 38 by means of holding screws 58 (FIG. 3**).

When the outside handle 16 is used to open the door locking mechanism, the outside handle must be tilted to the 37 degree position, and during this movement the end of the tongue 52 will be carried through an edge slot 60 which is in registration with the slot 54. At the fully tilted position, the outer end of the tongue 52 will be disposed above the outer adjacent surface of the plastic insert 56, and in this position will permit rotative operative movement of the handle 16. Should the handle be released at any point during its rotative movement, except when the end of the tongue 52 is in registration with the slot 60, biased movement of the handle will cause the end of the tongue 52 to engage the adjacent surface of the plastic insert and thus retain the handle in fully inclined position until the tongue is brought into registration with the slot 60, whereupon it will be biased into its flush position.

By virtue of the previously described arrangement, which permits movement of the lobe portion **40*a* between stop positions in engagement with the hub lugs 44, the inside handle may be actuated to directly move the bolt locking mechanism into locked or unlocked positions independently of the outside handle. As will now be explained, provision is made for moving the outside handle from its recessed position to a lesser degree of tilt in which it is restrained against rotation, but in which position it serves as a visual indication on the outside of the door that the door has been unlocked from the inside. For this purpose, the head plate member 40, as best shown in FIG. 5, is provided on the opposite side from the lobe portion 40*a* with a spindle cam portion 40*b* having a camming edge 62 which is adapted upon movement of the inside handle the door unlocked position to engage the end of the tongue 52 and cam it from the slot 54 into slot 60, in which position the handle will be tilted to a substantially 25 degree angle, but will be retained by the plastic insert 56** against operative rotative movement. In this tilted position, however, the handle does serve as an outside visual indicator that the door has been unlocked from the inside.

In some installations it is a necessary requirement that some form of manually controlled means shall be provided for locking or latching the outside handle against movement from its flush position. In the embodiment shown in FIG. 1, this requirement is met by the mounting of a key-controlled lock cylinder, as generally indicated at 64, on the outside handle. As best shown in FIG. 4, this lock cylinder is of conventional construction and includes a locking member 66 which may be key rotated into locked and unlocked relation with respect to an appropriate associated holding keeper 68. It will, therefore, be appreciated that in such an arrangement, it would not be possible to move the outside handle 16 from its flush position by the actuation of the cam 40*b* by the inside handle. Provision is therefore made for releasing the holding keeper 68 with respect to the locking member 66 prior to effecting movement of the outside handle 16 at the instance of the camming action of the cam 40*b* and associated tongue portion 52. As shown in FIGS. 4 and 5, the keeper is mounted upon a rocker shaft 70 which has its ends rotatably supported in cavity sidewalls 72 and 74 of the frame housing structure 10. The keeper is formed with a transversely extending shoulder 76 which is adapted in the holding position of the keeper to overlie the outer end of the locking member, when it is turned to a locked position. One end of the rocker shaft 70 is connected with a radially extending arm 78 which is appropriately biased by means of a torsion spring 80 in a direction to maintain the keeper in its holding position.

Provision is made for moving the keeper to a released position in advance of the utilization of the cam 40*b* to move the outside handle 16 out of its flush position. This is accomplished by means of another cam 82 which is formed as a part of the bell crank plate 20 and has a camming edge 84 against which the lever 78 is normally biased into engagement. As thus arranged, when the inside handle is utilized to move the locking mechanism to an unlocked position, the cam 82 will effect movement of the holding keeper 68 to a non-holding position with respect to the locking member 66 prior to movement of the outside handle 16 from its flush position by the action of the cam 40*b*.

Figure 6:
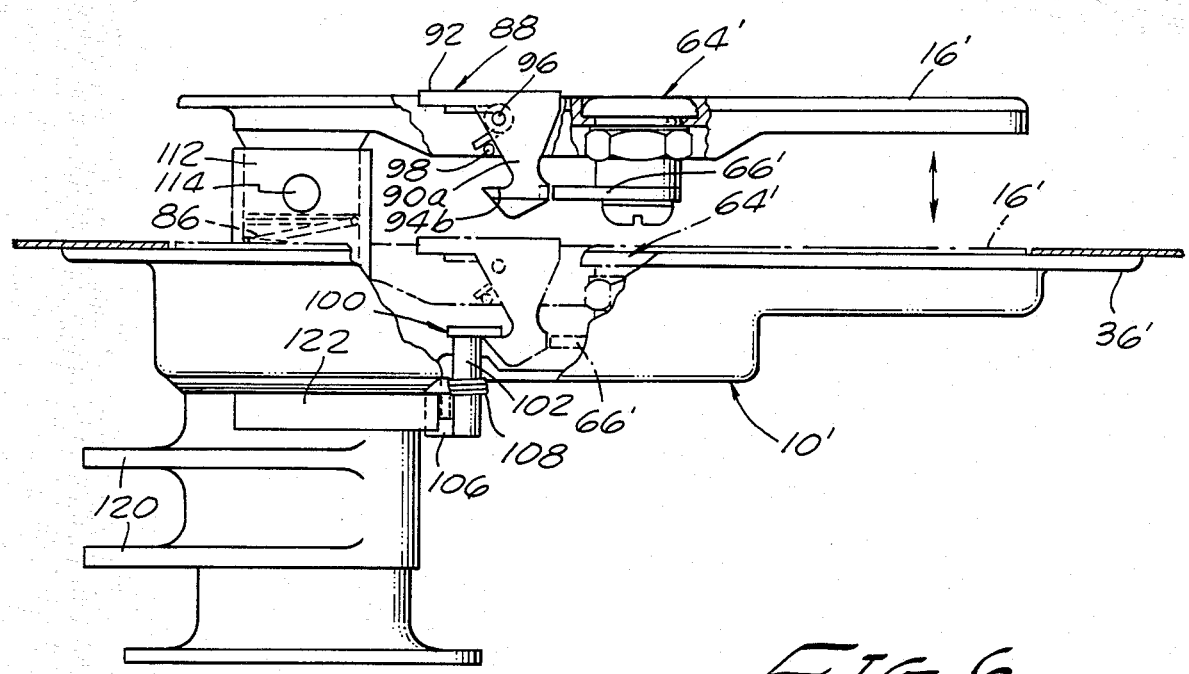
FIG. 6 is a view similar to FIG. 2 for another embodiment of the invention in which the outside handle is of a pop-up type.
Figure 7:
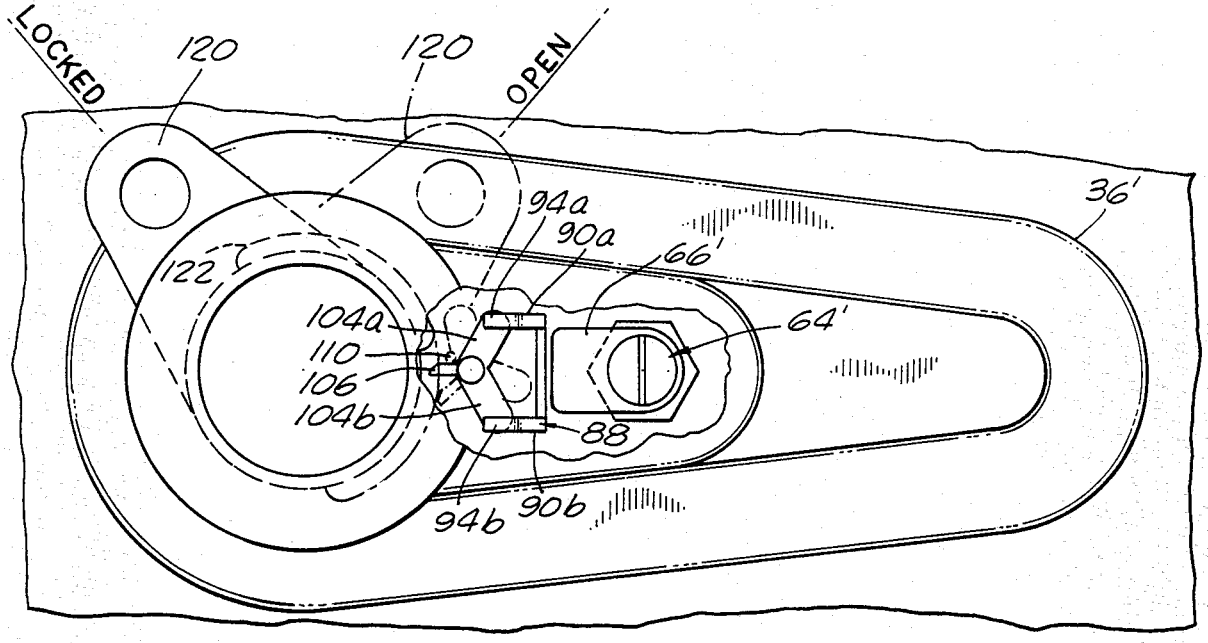
FIG. 7 is a view similar to FIG. 3, for the embodiment shown in FIG. 6, cutaway portions disclosing details of the cam actuated means for releasing the holding latch for the outside handle.

Referring now to FIGS. 6 and 7, the embodiment disclosed therein is basically similar to that as shown in FIGS. 1–5, but primarily differs in that a pop-up type of outside handle is utilized as indicated at 16', and wherein the other similar elements have been indicated by primed numbers.

In this embodiment, the outside handle 16' has the general configuration of the handle shown in FIG. 1, but in this case is supported for rectilinear movement between its flush position and non-flush position. A compression spring 86 normally biases the handle 16' from its flush position to its non-flush position. As a consequence, it becomes necessary to provide means for releasably retaining the handle 16' in its flush position. For such purpose, there is provided a manually operable latch, as generally indicated by the numeral 88. This latch is of generally inverted U-shape and is fabricated to provide spaced apart leg portions 90*a* and 90*b*, these leg portions being connected by a bridging portion 92 which is adapted to be positioned in a surrounding opening in the outer exposed surface of the outside handle. The other ends of the legs 90*a* and 90*b* are formed to provide latching hooks 94*a* and 94*b*. The latch is supported upon a transversely extending pivot 96 and is biased by means of a coiled spring which surrounds the pivot and has one end bearing against the undersurface of the bridging portion and its other end engaged with a pin 98 which also serves to limit the biased movement of the latch towards its latching position. By applying pressure against the bridging portion, the latch may be moved to a non-latched position.

In the seated flush position of the outside handle 16', the latch is adapted to latchingly engage a releasable holding keeper, and generally indicated by the numeral 100. This keeper comprises a rotatable shaft 102 that is rotatably supported in an adjacent wall of the frame housing cavity, and is provided at its cavity end with a pair of oppositely extending arms 104*a* and 104*b* which are engagable by the latch leg portions 90*a* and 90*b* in the flush position of the outside handle 16'. The other end of the rotatable shaft is connected to a radial projecting arm 106. A torsion spring 108 is operative to bias the keeper arms 104*a* and 104*b* towards a holding position as determined by means of an appropriate stop pin 110. As thus arranged, it will be apparent that movement of the arm 106 away from the stop pin 110 will function to rotate the arms 104*a* and 104*b* into a non-holding position, as shown in phantom lines in FIG. 7, so as to release the holding latch and permit movement of the outside handle 16' from its flush position to a pop-up, non-flush position as shown in full lines in FIG. 6.

The outside handle 16' is affixed to a supporting sleeve member 112 as by a pin 114. The inside handle would in this case be secured by conventional means to a rotatably mounted tubular support 118 in coaxial alignment with the sleeve member 112, and as in the case of the embodiment of FIG. 1, will incorporate a similar connection arrangement between the tubular support 118 and the sleeve member 112. This lost motion connection will also permit rotative movements of the tubular support 118 independently of the sleeve member 112, and thus enable actuation of the door locking mechanism by means of crank arms 120 carried by the tubular support of 118.

In this embodiment, provision is made for releasing the holding latch of the outside handle 16' in order that it may be biased to its pop-up position and serve as an indication of actuation of the door locking mechanism to an unlocked position by the inside handle. For this purpose, the tubular support 118 mounts an arcuate cam 122 which is arranged during movement of the inside handle from a door locked to a door unlocked position, to engage and coact with the radial arm 106 as a cam follower to move it away from the stop pin 110 and thus activate the keeper arms 104*a*, 104*b* into a release position to enable pop-up movement of the outside handle 16' to its non-flush position to indicate that the door has been unlocked from the inside.

It may be noted that as long as the door remains in an unlocked position, movement of the outside handle from its pop-up position to its flush position will be ineffective to operate the latch and hold the handle in its flush position. Therefore, as soon as the handle is released it will again pop-up to a non-flush position and indicate that the door is still in an unlocked position.

In some installations, it is desired to also utilize a key-controlled lock cylinder in conjunction with the latch mechanism 88. In such case, the lock cylinder is so positioned that movement of the locking member 66' to a locked position will prevent movement of the latch to an unlatched position. Even though the latch is thus locked in a latching position, release of the keeper will still be effective and will enable movement of the outside handle 16' into a pop-up indicating position.

It is believed that the operation of the actuating mechanism of the present invention will be clearly apparent from the foregoing description, that the outlined objects of the invention will be attained, and that the unique and cooperative relation of the respective elements will provide desirable operating advantages over the prior known structures.

Various modifications may suggest themselves to those skilled in the art without departing from the spirit of the disclosed invention, and, hence, it is not wished to be restricted to the specific forms shown or uses mentioned, except to the extent indicated in the appended claims.

I claim:

1. In a locking mechanism for an aircraft door having an outside actuating handle supported for movement between a normal flush position and a non-flush position, and an inside actuating handle, the improvement comprising:

means operable in response to the selective actuation of said outside handle and said inside handle for moving said locking mechanism into locked and unlocked positions;

manually releasable means operable to normally oppose movement of said outside handle from said flush position to a non-flush position;

means operable in response to a predetermined movement of the inside actuating handle in an unlocking direction including:

a bolt actuating bell crank for moving said locking mechanism into an unlocked position; and camming means for releasing said releasable means comprising a comming surface on said bell crank and a cam follower operatively associated with said releasable means; and other means operable in response to said predetermined movement of the inside handle for moving the outside handle to a non-flush position in which it serves as a visual indicator that said door locking mechanism is in an unlocked position.

2. A locking mechanism according to claim 1, in which:

said releasable means comprises a keeper supported for movements to holding and non-holding positions, said keeper having an actuating connection with said follower.

3. A locking mechanism according to claim 1, in which:

the means operable by the inside handle to move the outside handle to a non-flush position comprises: rotary cam actuated means.

4. A locking mechanism according to claim 3, in which:

the cam actuated means includes a rotary cam member connected for movement with said inside handle;

said outside handle is pivoted between its ends for tilting movement between said flush and non-flush positions and is formed with a projecting tongue portion on one side of its pivot adapted in the flush position of said outside handle to be disposed in the path of movement of said cam, and being operable thereby to swing the outside handle from said flush position to the non-flush position.

5. A locking mechanism according to claim 4, in which:

said cam member is so rotatably oriented with respect to the rotation of said inside handle that the outside handle will be activated to said non-flush position when the inside handle is moved to said unlocked position.

6. A locking mechanism according to claim 4, in which:

said outside handle is normally biased towards said flush position.

7. A locking mechanism according to claim 1, in which:

said manually releasable means comprises: a key-controlled locking cylinder carried by said outside handle, and having a locking member movable into locked and unlocked positions; and a movably mounted keeper engaged in said locked position by said locking member in said flush position of said outside handle, and being movably disengageable from said locking member in response to said movement of said inside handle.

8. A locking mechanism according to claim 1, in which:

said outside handle is manually operable from the door exterior to a non-flush position in which said locking mechanism may be moved to locked and unlocked positions independently of said inside handle.

9. A locking mechanism according to claim 4, in which:

a rotatably supported element fixedly mounts spaced apart lugs upon which the outside handle is pivoted;

said rotary cam member is positioned between said lugs and is rotatable in opposite directions between stop positions of engagement with said lugs; and said projecting tongue, in a flush position of said outer handle, is positioned in a notch on said rotatable element, and is radially movable by the action of said cam from said notch into a notch formed in an adjacent fixed holding member.

10. A locking mechanism according to claim 9, in which said adjacent fixed member comprises an annular insert co-axially surrounding said rotatably supported element, and whereby, upon further manual tilting movement of the outside handle the projecting tongue will be released from said holding notch and enable rotational movement of the outside handle so as to independently actuate the locking mechanism; and in which said annular insert serves as a stop in coaction with said projecting tongue to retain the outer handle in a fully tilted non-flush position so long as the tongue is not in registration with said holding notch.

11. In a locking mechanism for an aircraft door having an outside actuating handle supported for movement between a normal flush position and a non-flush position, and an inside actuating handle, the improvement comprising:

means operable in response to the selective actuation of said outside handle and said inside handle for moving said locking mechanism into locked and unlocked positions;

manually releasable means operable to normally oppose movement of said outside handle from said flush positions to a non-flush position;

means operable in response to a predetermined movement of the inside actuating handle in an unlocking direction including:

a bolt actuating bell crank for moving said locking mechanism into an unlocked position; and camming means for releasing said releasable means comprising a camming surface on said bell crank and a cam follower operatively associated with said releasable means; and other means operable in response to the release of said releasable means for moving the outside handle to a non-flush position in which it serves as a visual indicator that the door locking mechanism has been moved to an unlocked position by the inside handle.

12. A locking mechanism according to claim 11, in which:

said outside handle is supported for pop-up movement from said flush position to said non-flush position; and said other means comprises a compression spring.

13. A locking mechanism according to claim 11, in which:

said manually releasable means comprises:

a spring biased latching lever carried by said outside handle; and a movably mounted keeper engaged by said latching lever in said flush position of said outside handle, said keeper being movable by said cam follower to a disengaged position with respect to said latching lever in response to unlocking movement of said inside handle.

14. A locking mechanism according to claim 13, in which:

a key-controlled locking cylinder means carried by said outside handle is operable to oppose movement of said latching lever to an unlatched position.

* * * * *